US005097568A

United States Patent [19]

Giglia

[11] Patent Number: 5,097,568

[45] Date of Patent: Mar. 24, 1992

[54] DIVIDER CLAMP ASSEMBLY

[75] Inventor: Robert D. Giglia, Westchester, N.Y.

[73] Assignee: American Cyanamid Company, Stamford, Conn.

[21] Appl. No.: 640,756

[22] Filed: Jan. 14, 1991

[51] Int. Cl.[5] ..... B65D 77/10; B65D 25/08

[52] U.S. Cl. ..... 24/30.5 R; 24/528; 206/221; 383/68

[58] Field of Search ..... 24/460, 461, 462, 30.5 R, 24/459, 528, 536, 543; 206/219, 221; 383/42, 63, 62, 68

[56] References Cited

U.S. PATENT DOCUMENTS

| | | | |
|---|---|---|---|
| 2,756,874 | 7/1956 | Erickson et al. | 206/221 |
| 2,815,554 | 12/1957 | Pieper | 24/528 |
| 3,082,867 | 3/1963 | Gelpey | 206/221 |
| 3,141,221 | 7/1964 | Faulls, Jr. | 24/30.5 R |
| 3,149,943 | 9/1964 | Amador | 206/221 X |
| 3,474,898 | 10/1969 | Montgomery | 206/219 |
| 3,539,794 | 11/1970 | Rauhut et al. | 206/221 X |
| 3,639,952 | 2/1972 | Thompson et al. | 206/221 x |
| 3,741,381 | 6/1973 | Thompson et al. | 206/221 |
| 4,401,214 | 8/1983 | Kleckers | 206/219 |
| 4,545,481 | 10/1985 | Smith | 206/219 |

FOREIGN PATENT DOCUMENTS

| | | | |
|---|---|---|---|
| 29326 | 2/1927 | Australia | 24/30.5 R |
| 203499 | 5/1956 | Australia | 24/30.5 R |
| 0342317 | 11/1989 | European Pat. Off. | 383/68 |
| 12298 | 5/1912 | United Kingdom | 24/30.5 R |
| 1018749 | 2/1966 | United Kingdom | 206/221 |

*Primary Examiner*—Bryon P. Gehman
*Attorney, Agent, or Firm*—Frank M. Van Riet

[57] ABSTRACT

A divider clamp assembly for use in compressing the opposed sidewalls of a tubular, flexible-walled container against one another, the assembly comprising a first member being substantially U-shaped in cross-section and a second member of substantially round cross-section, the interior surface of the first member conforming in shape with the exterior shape of said second member, the U-shaped member preferably having integral, sharp edged ribs extending lengthwise on its inner surface and having oval-shaped rings on each of its ends positioned such that the rings hold the second member within each interior thereof, the second member being enlarged on both ends such that it may not be separated from the first member but may be compressed into the interior of the first member to form a tight fit therewith.

4 Claims, 2 Drawing Sheets

DIVIDER CLAMP ASSEMBLY

BACKGROUND OF THE INVENTION

This invention relates to a divider clamp assembly used to separate components in a mixing package comprising a bag of a strong and flexible sheet material which is divided in at least two component containing compartments to prevent the two components from mixing and chemically reacting until the reacting composition is ready for use wherein the clamp is removed and the two components are contacted in the then single mixing chamber.

Clamping dividers have long been known and used in dual package systems Chemical refrigerant packages for first aid U.S. Pat. No. 3,149,943; rockbolt resins, U.S. Pat. No. 3,474,898; chemical light, U.S. Pat. No. 3,539,794; two component resin and catalyst systems U.S. Pat. No. 3,741,381; resin and catalyst composition for orthotics, U.S. Pat. No. 4,211,019 and polyurethane foam producing liquid for heat insulation, U.S. Pat. No. 4.401,214, are examples of the widely used two package systems which utilize clamping divider devices.

The clamping divider of this invention improves upon the known pin and clip dividers by providing a means of keeping the pin and clip from flying apart inadvertently or during activation and possibly injuring the user. The improved device facilitates disposal of the pin and clip with the package as a single unit and offers an added advantage of facilitating resealing for special purpose packages

SUMMARY OF THE INVENTION

According to the present invention there is provided a divider clamp assembly for use in clamping the opposed sidewalls of a tubular, flexible-walled container against one another, said divider assembly comprising a pair of elongated first and second members shaped to internest in strong friction contact with one another, said first member being substantially U-shaped in cross-section and having an interior surface and two ends and said second member being substantially round in cross-section and longer than said first member, the interior surface of said first member conforming in shape with half the exterior shape of said second member and being sized to firmly receive said second member, said first member having a narrow oval-shaped ring rising above its both of its ends, each ring forming an elongated saddle, the interior of the oval rings being adapted to accommodate the second member within both oval rings and parallel with the first member, said second member being enlarged on both ends so that the enlarged ends are larger in diameter than the inner edges of the oval rings thereby preventing the second member from separating from the first member.

The U-shaped first member of the clamp assembly and its rings are preferably made from a resilient polymer such as polypropylene and is relatively stiff and of greater resiliency than the second member which is preferably made from a more rigid, nonresilient polymer such as polystyrene. The interior surface of the first member has three sharp-edged ribs extending lengthwise with one rib on the bottom of the U-shaped surface and one each on either side of the upper section of the U-shaped surface.

The three ribs preferably extend through the complete length of the first member.

The rod-shaped second member or mandrel is placed through the two oval ends or rings lengthwise to the U-shaped member and is then swaged or enlarged on each end so that the ends are larger in diameter than the inner opening of the oval, thus preventing separation of the two members.

The divider clamp is preferably useful in separating the activator component in a chemiluminescent device from an absorbent material containing oxalate and fluorescer components, the device containing the components in a sealed laminated metal foil tube wherein the sponge pad side of the tube has a clear polyethylene or polypropylene window from which chemical light is emitted when the device is activated by opening the clamp and allowing the activator to flow onto the sponge pad and mix with the absorbed oxalate/-fluorescer.

DETAILED DESCRIPTION OF THE DRAWINGS

The preferred embodiment of the invention is illustrated in the drawings.

DESCRIPTION OF THE INVENTION INCLUDING PREFERRED EMBODIMENTS

The present invention provides a two component, clip divider for a compartmented package comprising a clip shell and pin and means to help retain the pin and clip shell components on the package after the divider is released and materials from both compartments of the package are mixed. The invention improves upon the known pin and clip type dividers by providing a means to prevent the pin from flying apart inadvertently or during activation and thereby injuring the user either during its flight or by causing the user to fall as a result of it being stepped on. The thus retained clip or bar facilitates the disposal of the device with the package and offers the further added advantage of facilitating resealing for special purpose uses. The invention is useful for packaging of chemical light components, as heretofore described, of two part adhesive systems and other compartmented packaging in which reactive components must be stored apart.

The invention is useful for systems in which chemically reactive constituents are isolated from one another in the opposite ends of an open single main container which is sealed on all sides. The improved divider clamping assembly may be employed to hold the walls of two sides of a container tightly against one another to form two pairs of completely isolated compartments at the opposite ends of the container. When activation of the system is desired, the clip may be released thereby allowing the reactants from the two compartments to mix.

The improved clamping and divider assembly includes a relative smooth surfaced, stiff, non-resilient member and a relatively stiff, highly resilient U-shaped member, which, in use, snugly embraces the non-resilient member against the interior section of the U-shaped member. Betwixt the cooperating members are the two container walls flattened and compressed against one another. Aiding very materially in holding the members assembled in this manner are three, sharp-edged ribs projecting inwardly from the inner surface of the U-shaped clip member. These ribs are positioned in parallel along the inside surface of the U-shaped clip member and are so arranged as to become operative against any tendency of the clamp or bar member to become disengaged from its sealed position and have been found to add greatly to the reliability and foolproof characteristics of the assembly.

The U-shaped member and its oval and rings are preferably made from polypropylene such that the device is stiff, however, it also must be flexible enough to allow sufficient deformation to allow the pin member to pass through the rings and the ribs to compress back on the pin even with repeated clamping and releasing of the device. However, other similar materials may be used to fabricate them.

Figure 3:
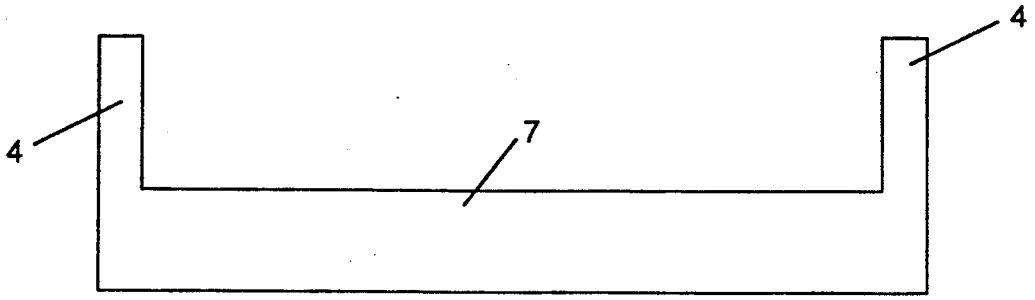
FIG. 3 is a side view of the first member, the main body of which is U-shaped (7).
Figure 4:
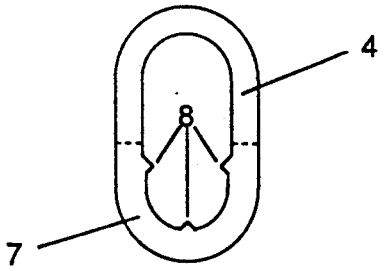
FIG. 4 is an end view of the device showing the exterior oval ring (4) of the device and the interior of U-shaped body (7) with three sharp-edged ribs (8) extending parallel to one another and to the axis of the pin or bar (2).

From each end of the U-shaped member an oval shaped ring rises above the member's base to form an elongated saddle as shown best in FIG. 3. The upper section of the oval shaped rings accommodates the smaller diameter, loosely fitting pin when the device is activated. The pin is longer than the U-shaped member. After the pin is placed through the two oval rings, it is swaged on both ends, preferably such as by heating, such that the ends are then of a larger diameter than the inner oval opening, thus permanently confining the pin within the U-shaped member. The device, when the pin is positioned in the upper section of the oval ring, is in an open position and when the pin is pressed down into the ribbed section the U-shaped member, is in a sealed position. The pin's diameter is such that true sealing occurs only when the sealed package is compressed between the pin and the interior of the U-shaped member.

The oval or racetrack-shaped ends or rings (4) of the U-shaped member project above the main body (7) of the U-shaped member.

Figure 1:
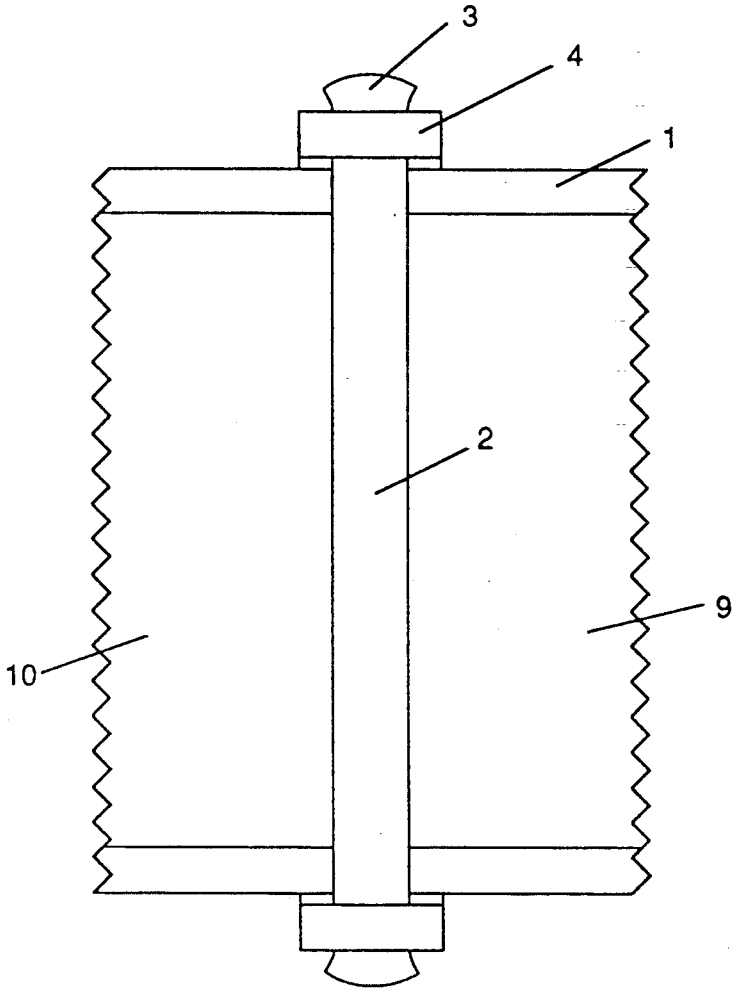
FIG. 1 is a top view of the clip and seal shown in use thereby separating compartment (9) of package (1) from compartment (10) thereof. The ends of the smooth round mandrel pin or bar (2) are enlarged (3) on the outside of the oval end rings (4) such that the mandrel may be raised and lowered within the limits allowed by the oval end but cannot slide out or be separated from the device.
Figure 2:
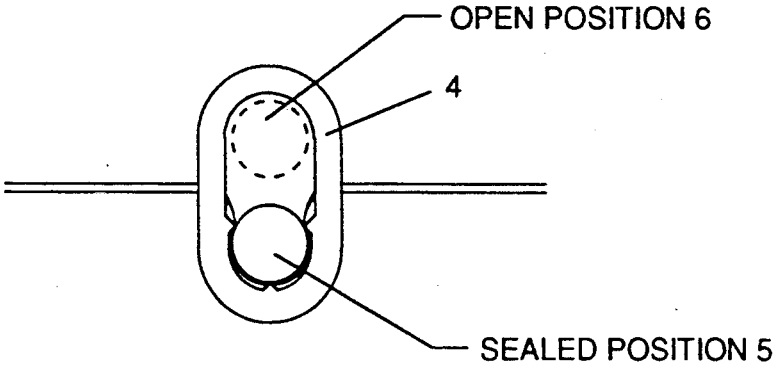
FIG. 2 is an end view of the device showing ring (4) of the U-shaped member in the sealed position (5) and the activated position (6) wherein the pin or bar (2) is not shown as swaged.

The pin is a round rod-shaped bar as shown best in FIG. 1. It is preferably made of polystyrene but may be made from metal or another plastic material provided that the material may be deformed on each end to a sufficiently large diameter to retain the pin within the body of the U-shaped member. Alternatively, an exterior piece may be affixed to the pin outside the ends of the rings to prevent the pin from sliding out of rings (4).

While the particular package assembly divider clamp herein shown and disclosed in detail is fully capable of attaining the objects and providing the advantages herein before stated, it is to be understood that it is merely illustrative of the presently preferred embodiment of the invention.

I claim:

1. A divider clamp assembly for use in clamping the opposed sidewalls of a tubular flexible-walled container against one another, said assembly comprising a pair of elongated first and second members shaped to internest in strong friction contact with one another, said first member being substantially U-shaped in cross-section and having an interior surface and two ends and said second member being substantially round in cross-section and longer than said first member, the interior surface of said first member conforming in shape with half of the exterior shape of said second member, having upper and bottom sections and being sized to firmly receive said second member, said first member having a narrow oval-shaped ring rising above both its ends, each ring forming an elongated saddle, the oval rings being adapted to accommodate the second member within their interiors and parallel with the first member, said second member being swaged on both its ends so that the swaged ends are larger in diameter than the inner edges of the oval rings thereby preventing the second member from separating from the first member.

2. A divider clamp assembly as defined in claim 1 characterized in that the first member is made from substantially resilient polypropylene.

3. A divider clamp assembly as defined in claim 1 characterized in that the second member is made from rigid, substantially non-resilient polystyrene.

4. A divider clamp assembly as defined in claim 1 characterized in that the first member has three sharp edged ribs extending lengthwise along its interior surface with one rib on the bottom section of the surface and one on each side of the upper section of the surface.

* * * * *